US005703433A

United States Patent [19]

Fujii et al.

[11] Patent Number: 5,703,433

[45] Date of Patent: Dec. 30, 1997

[54] PLASMA DISPLAY PANEL AND METHOD FOR FORMING FLUORESCENT SCREENS OF THE SAME

[75] Inventors: Hideaki Fujii; Hiroshi Ishiga; Masatoshi Harayama; Motohiro Oka, all of Tokyo, Japan

[73] Assignee: Dai Nippon Printing Co., Ltd., Japan

[21] Appl. No.: 752,602

[22] Filed: Nov. 19, 1996

Related U.S. Application Data

[62] Division of Ser. No. 618,771, Mar. 20, 1996, Pat. No. 5,601,468, which is a continuation of Ser. No. 274,780, Jul. 14, 1994, abandoned, which is a continuation of Ser. No. 960,110, Oct. 13, 1992, abandoned.

[30] Foreign Application Priority Data

| | | | |
|---|---|---|---|
| Oct. 14, 1991 | [JP] | Japan | 3-292025 |
| Nov. 21, 1991 | [JP] | Japan | 3-331559 |
| Jun. 23, 1992 | [JP] | Japan | 4-187399 |

[51] Int. Cl.[6] ..... H01J 29/24; H01J 17/49

[52] U.S. Cl. ..... 313/484

[58] Field of Search ..... 313/484, 485, 313/487, 482

[56] References Cited

U.S. PATENT DOCUMENTS

| | | | |
|---|---|---|---|
| 5,041,759 | 8/1991 | Kwon et al. | 313/497 |
| 5,086,297 | 2/1992 | Miyake et al. | 340/759 |
| 5,136,207 | 8/1992 | Miyake et al. | 313/484 X |
| 5,144,200 | 9/1992 | Kim | 313/584 |

*Primary Examiner*—Kenneth J. Ramsey
*Attorney, Agent, or Firm*—Parkhurst, Wendel & Burr, L.L.P.

[57] ABSTRACT

Predetermined barrier ribs 2 are filled with three types of pastes of fluorescent substances 3 for R, G, and B by a screen printing method. Next, a sandblasting process is performed through a sandblasting mask 7. Thereafter, a sintering process is performed. Thus, fluorescent screens are formed on a glass substrate 1 and the wall surfaces of barrier ribs 2. As the sandblasting mask 7, a photoresist 4 is used. By a photolithographic method, a desired pattern of the sandblasting mask 7 can be used. In this manner, fluorescent screens can be formed on the wall surfaces of the barrier ribs as well as the glass substrate 1. The fluorescent screens formed on the wall surfaces of the barrier ribs are in such a parabolic shape that a discharging space defined by the fluorescent screen is widened toward a front plate 11.

5 Claims, 13 Drawing Sheets

PLASMA DISPLAY PANEL AND METHOD FOR FORMING FLUORESCENT SCREENS OF THE SAME

This is a divisional of application Ser. No. 08/618,771, filed Mar. 20, 1996 now U.S. Pat. No. 5,601,468 which is a Rule 60 continuation of Ser. No. 08/274,780, filed Jul. 14, 1994, now abandoned, which in turn is a Rule 62 Continuation of Ser. No. 07/960,110, filed Oct. 13, 1992, now abandoned.

BACKGROUND OF THE INVENTION

1. Field of the Invention

The present invention relates to a plasma display panel and to a method for forming fluorescent screens of the same.

2. Description of the Related Art

A plasma display panel comprising a rear plate (glass substrate), a front plate, and barrier ribs disposed therebetween is known. A method for forming fluorescent screens of a plasma display panel is known which comprises the steps of coating a photosensitive solution dispersed with a fluorescent substance on a glass substrate, drying the glass substrate, radiating rays of light containing an absorption wavelength of the photosensitive solution to the glass substrate through a mask with a predetermined pattern so as to harden the light-exposed portion, developing the exposed portion, and removing the remaining portion of the photosensitive substance. In this method, by repeating the above-mentioned steps using three types of fluorescent substances for red (R), green (G), and blue (B) colors, desired fluorescent screens can be formed. Another known method for forming fluorescent screens on a glass substrate includes printing three types of pastes of screen printing fluorescent substance for R, G, and B thereon by using screen printing process.

On a plasma display panel, so as to improve luminous efficiency with limited amount of energy, it is preferable to form fluorescent screens on the wall surfaces of barrier ribs along with the surface of a glass substrate. However, in the above-mentioned conventional method (photolithography method) and screen printing method, it was difficult to form fluorescent screens on the wall surfaces of barrier ribs.

SUMMARY OF THE INVENTION

The present invention has been created in order to solve the problems as described above of the prior art. An object of the present invention is to provide a plasma display panel having fluorescent screens on the wall surfaces of barrier ribs along with the surface of a glass substrate and a method for forming the fluorescent screens of the same.

A first aspect of the present invention is a plasma display panel, comprising a rear plate, a front plate, and barrier ribs disposed between the rear plate and the front plate, wherein a fluorescent screen is formed on wall surfaces of each of the barrier ribs, the horizontal area in a discharging space defined and formed by the fluorescent screen gradually increasing toward the front plate, the film thickness of the fluorescent screen being in the range from 20 to 50 μm nearly at the center position of each wall surface of each of the barrier ribs.

A second aspect of the present invention is a method for forming fluorescent screens of a plasma display panel, comprising the steps of disposing a plurality of barrier ribs on a rear plate, filling predetermined discharging spaces with three types of paste of fluorescent substances for red, green, and blue, performing a sandblasting process using a sandblasting mask with openings, each of the openings being smaller than the area of each of the discharging spaces, and performing a sintering process so as to form the fluorescent screens on the rear plate and the wall surfaces of the barrier ribs.

A third aspect of the present invention is a method for forming fluorescent screens of a plasma display panel, comprising the steps of, disposing a plurality of barrier ribs on a rear plate having first electrodes, filling predetermined discharging spaces with three types of pastes of fluorescent substances for red, green, and blue, drying the pastes of fluorescent substances so as to vaporize the solvent contained in the pastes of fluorescent substances, performing a sandblasting process so as to remove unnecessary fluorescent substances from the wall surfaces of the barrier ribs with necessary fluorescent substances being left, and performing a sintering process so as to securely adhere the fluorescent screens on the wall surfaces of the barrier ribs.

A fourth aspect of the present invention is a method for forming fluorescent screens of a plasma display, comprising the steps of disposing a plurality of the barrier ribs on a rear plate, surfaces of the barrier ribs containing predetermined bridging agent, filling predetermined spaces with a paste of fluorescent substance containing a resin to be bridged with the bridging agent, leaving the rear plate for a predetermined bridging reaction time, and developing the paste of fluorescent substance so as to form the fluorescent screens on the wall surfaces of the barrier ribs.

According to the first aspect of the present invention, since the horizontal area in the discharging space formed inside each fluorescent screen gradually increases toward the front plate, rays of light emitted from the fluorescent screen can be effectively radiated toward the front plate. In addition, since the film thickness of each fluorescent screen nearly at the center position on each wall surface of each barrier rib is in the range from 20 to 50 μm, the luminance of rays of light emitted from the fluorescent screen can be increased.

According to the second aspect of the present invention, after predetermined discharging barrier ribs are filled with the paste of fluorescent substance for each color, a sandblasting process is performed using the sandblasting mask. Thus, unnecessary portions of the paste of fluorescent substance are removed. Therefore, necessary paste of the fluorescent substance remain on the surfaces of each barrier rib along with the surface of glass substrate. As a result, the residual paste of fluorescent substance causes the fluorescent screens of the fluorescent substance to be formed not only on the surface of glass substrate, but also on the surfaces of each barrier rib.

According to the third aspect of the present invention, after the solvent contained in the paste of fluorescent substance in each of predetermined barrier ribs is vaporized, a mixture of fluorescent substance and binder remains on the surfaces of the barrier rib and at the bottom of the discharging space. After the drying step, the fluorescent screens remaining in the cell space assume such a form. In addition, since the sandblast processing speed (digging speed by sandblast) against the fluorescent screens is higher than that against the materials of electrodes and barrier ribs, the fluorescent screens can be formed on the wall surfaces of each barrier rib under control of sandblasting process conditions and the operating time thereof with almost no damage to the surfaces of the electrodes and the upper portion of the barrier rib. Moreover, in this process, a sandblasting mask is not required.

According to the fourth aspect of the present invention, the bridging agent provided in each barrier rib causes the resin contained in the paste of fluorescent substance in each discharging space to be bridged and hardened in the vicinity of each wall surface of the barrier rib. Thus, a fluorescent screen is formed on each wall surface of the barrier rib. The film thickness of each fluorescent screen is controlled by the density of bridging agent provided in the barrier rib, the density of resin contained in the paste of fluorescent substance, the bridging reaction time required from the filling process to the developing process, and the developing intensity.

These and other objects, features and advantages of the present invention will become more apparent in light of the following detailed description of a best mode embodiment thereof, as illustrated in the accompanying drawings.

DESCRIPTION OF PREFERRED EMBODIMENTS

First Embodiment

1-1 Basic Construction

Figure 1A:
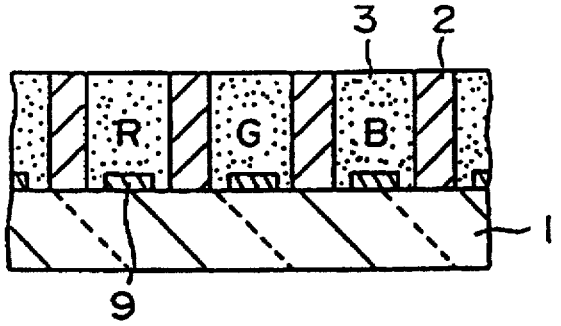
FIGS. 1(*a*) to 1(*h*) are schematic sectional views showing steps of a method for forming fluorescent screens of a plasma display panel in accordance with a first embodiment of the present invention.
Figure 1B:
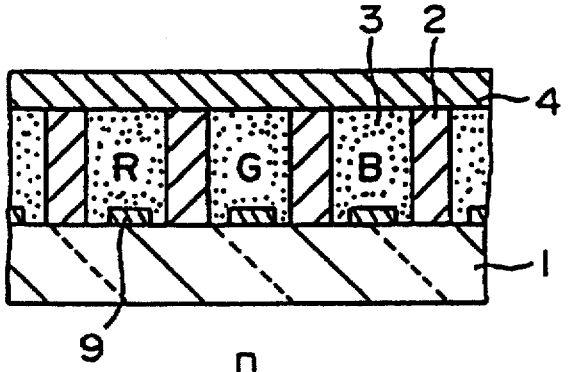
Figure 1C:
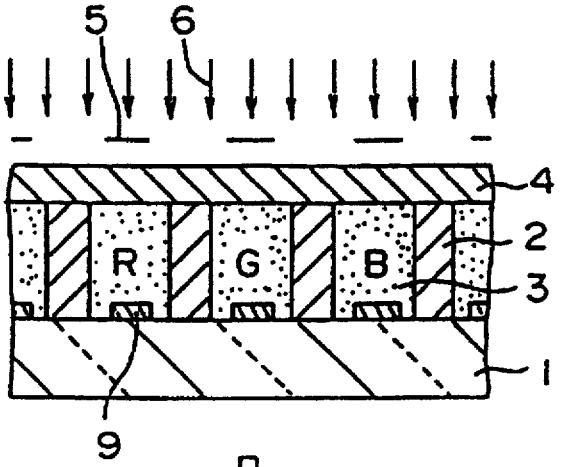
Figure 1D:
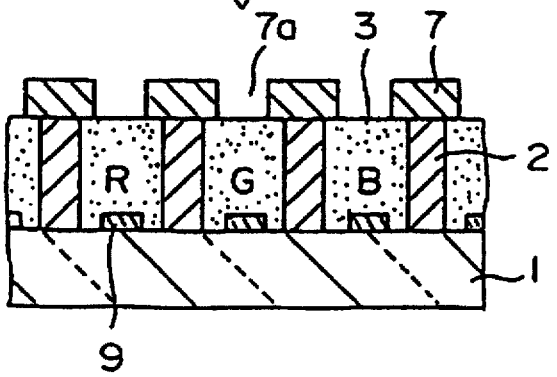
Figure 1E:
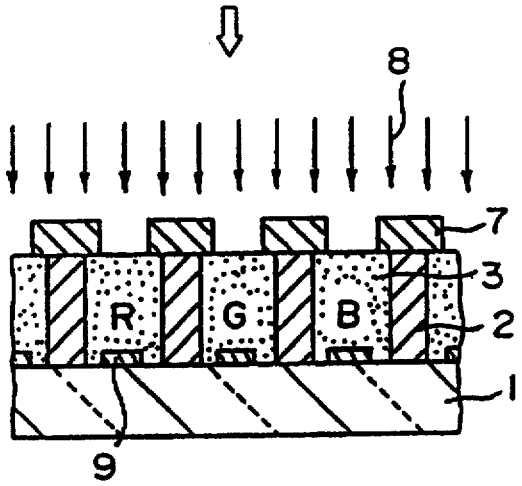
Figure 1F:
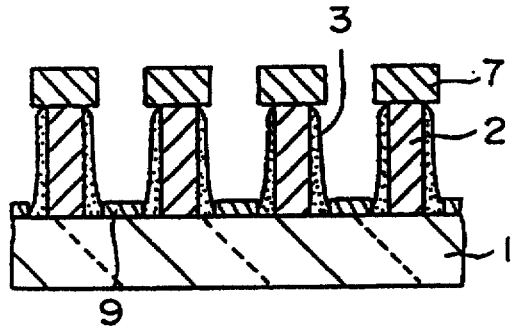
Figure 1G:
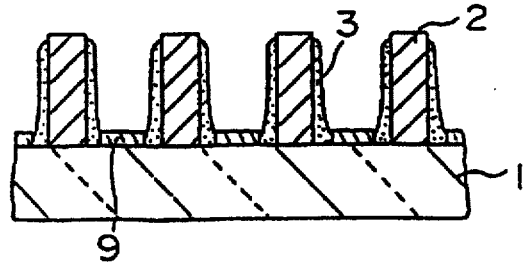
Figure 1H:
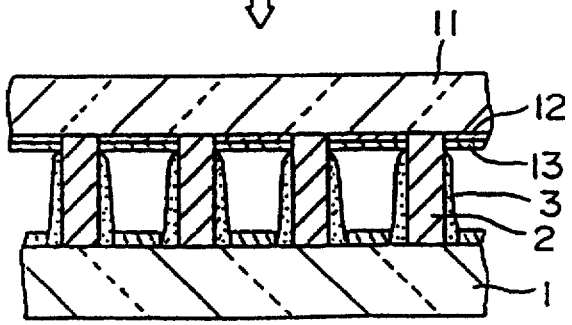

With reference to the accompanying drawings, embodiments of the present invention will be described.

FIGS. 1(*a*) to 1(*h*), 2A, 2B, 3A, 3B and 3C show a first embodiment in accordance with the present invention. FIGS. 1(*a*) to 1(*h*) are schematic diagrams showing continuous steps of a method for forming fluorescent screens of a plasma display in accordance with the present invention. Next, this method will be described step by step.

As shown in FIG. 1(*a*), discharging spaces defined by barrier ribs 2 which have been formed on a glass substrate (rear plate) 1 are filled with three types of pastes of fluorescent substances 3 for red (R), green (G), and blue (B) colors by a screen printing method in such a way that each color of paste is arranged in a specific sequence. In this embodiment, the barrier ribs 2 are patterned in a matrix shape with a pitch of 500 μm and a line width of 100 μm. In each discharging space on the glass substrate 1, an electrode 9 has been disposed. Next, the fluorescent pastes 3 are dried so as to remove a solvent contained in an organic binder thereof. Then, the substrate 1 is heated at a temperature in the range from 50° to 80° as shown in FIG. 1(*b*). Thereafter, a light-hardening type dry film (OSBR film made by Tokyo Ouka Kogyo Kabushiki Kaisha) is laminated on the substrate 1 as a photoresist 4. Next, as shown in FIG. 1(*c*), the pattern is exposed to ultraviolet rays 6 through a dot pattern mask 5 with a pitch of 500 μm and openings of 300 μm sq. It should be noted that the dry film can be laminated on the substrate 1 which is being heated. The exposure conditions are an intensity of 200 $\mu W/cm^2$ and an amount of radiation of 70 $mJ/cm^2$ when measured at a position spaced apart by 365 nm. Next, in a developing step shown in FIG. 1(*d*), the pattern is developed by spraying thereon an aqueous solution of sodium carbonate anhydride of 0.2 wt % at a temperature in the range from 30° to 50°. Thus, a sandblasting mask 7 having a grid pattern with a pitch of 500 μm and a line width of 200 μm is obtained on the barrier ribs 2 and the pastes of fluorescent substances 3. The area of each opening 7*a* of the sandblasting mask is smaller than the opening area of a discharging space formed in each barrier rib 2.

Thereafter, through a drying step, as shown in FIG. 1(*e*), grains of sandblasting sand 8 are blasted so as to remove unnecessary portions of each fluorescent substance. In this step, brown color molten alumina #400 is used as the sand (abrasive). By performing the sandblasting process under the condition of a blowing pressure ranging from 1 $kg/cm^2$ to 3 $kg/cm^2$, the pastes of fluorescent substances 3 with a film thickness of 50 μm adhere to the surface of the glass substrate and the wall surfaces of the barrier ribs 2 and thereby a pattern of the fluorescent screens is formed, as shown in FIG. 1(*f*). The film thickness of the pastes of fluorescent substances 3 adhering to the glass substrate 1 can be controlled by the conditions of the sandblasting process and the operating time thereof. In a baking step shown in FIG. 1(*g*), the pastes of fluorescent substances 3 are sintered at a peak temperature of 450° C. for a holding time of 10 to 20 minutes. Thus, the fluorescent screens are securely formed on the glass substrate 1 and the wall surfaces of the barrier ribs 2. At this point, the sandblasting mask 7 is burned out. As a result, the fluorescent screens 3 for R, G, and B having a film thickness of 40 μm at the center portion of the barrier ribs in a height direction thereof are formed in predetermined positions of the surface of the glass substrate 1 and the wall surfaces of the barrier ribs 2.

Next, as shown in FIG. 1(*h*), a front plate 11 is placed on the barrier ribs 2. On the front plate 11, electrodes 12 and fluorescent screens 13 have been previously laminated in sequence. In other words, the fluorescent screens 13 are opposed to respective electrodes 9 through respective discharging spaces. As a result, a plasma display panel is obtained. It should be appreciated that the fluorescent screens 13 on the front plate 11 can be formed by screen printing method, sandblasting process, exposing process, and so forth. The film thickness of the fluorescent substances 13 on the front plate 11 is preferably in the range from 5 to 10 μm so that the fluorescent substances 13 can transmit rays of light.

In this embodiment, as a photoresist 4 constituting the sandblasting mask 7, the above-mentioned light-hardening type dry film is used. However, it should be noted that such selection does not limit the present invention. Instead, a proper photoresist can be selected in accordance with the size of a desired pattern, the appropriateness as a mask for use in the sandblasting process, and so forth.

Figure 16:
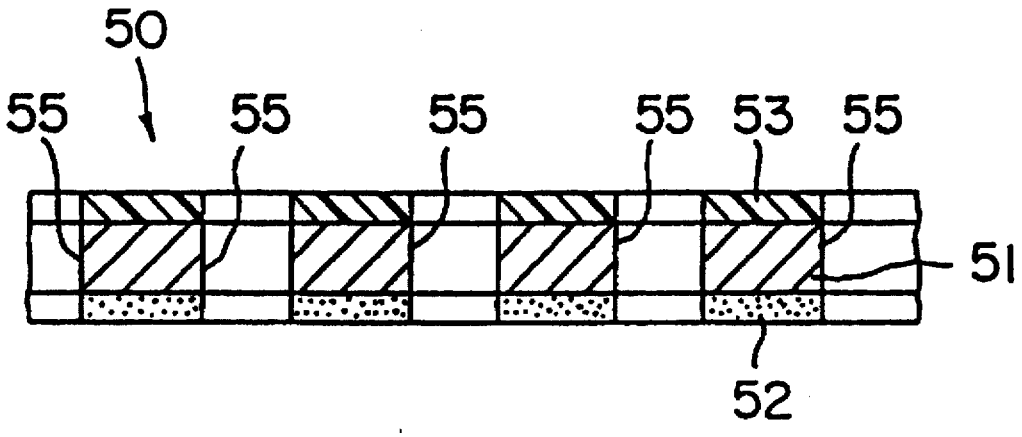
FIG. 16 is a side sectional view showing a metal mask.
Figure 17:
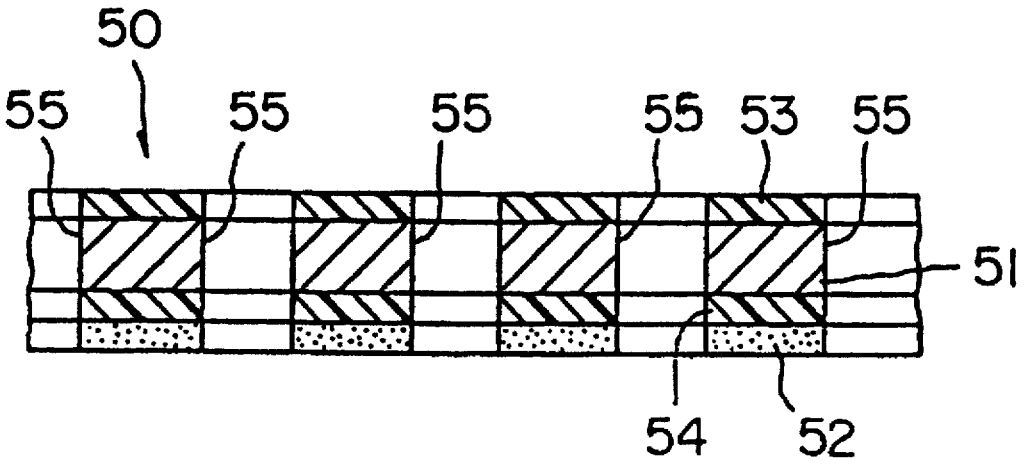
FIG. 17 is a side sectional view showing another metal mask.

In addition to the above-mentioned resin mask for the sandblasting mask, a metal mask having an etched pattern and made of steel, stainless steel, or the like can be used. FIGS. 16 and 17 show examples of such metal masks.

As shown in FIG. 16, a metal mask 50 comprises a thin metal plate 51, an adhesive layer 52, and a protection layer 53. The thin metal plate 51 is made of stainless steel or the like. The adhesive layer 52 is disposed on the rear surface of the thin metal plate 51. The protection layer 53 is disposed on the front surface of the thin metal plate 51. The thin metal plate 51 has openings 55 at positions in accordance with the discharging spaces (see FIG. 2B), the size of each opening 55 being smaller than each of discharging space 30. The adhesive layer 52 is formed by coating an adhesive agent on the thin metal plate 51. The adhesive layer 52 causes the metal mask 50 to contact closely the upper surface of each barrier rib 2. In addition, the adhesive layer 52 absorbs rebounding forces of abrasive during the sandblasting process. On the other hand, the protection layer 53 is formed by laminating a dry film or roll- or spray-coating a rubber type resist and then by patterning the thin metal plate 51 in accordance with each opening 55. Alternatively, the protection layer 53 is formed by coating a cushioning resin so as to prevent each opening 55 of the thin metal plate 51 from being closed. This protection layer 53 absorbs shocks of abrasive during the sandblasting process so as to prevent the thin metal plate (in particular, edge portion thereof) from being worn, heated, and deformed.

A metal mask 50 shown in FIG. 17 further comprises a cushion layer 54 composed of a dry film or the like along with the thin metal plate 51, the adhesive layer 52, and so forth of FIG. 16. The cushion layer 54 is disposed between the thin metal plate 51 and the adhesive layer 52. This metal mask 50 has a significant effect in absorbing rebounding forces of abrasive during the sandblasting process.

Moreover, when the discharging spaces are filled with the pastes of fluorescent substances, besides the screen printing method described above, another means such as a spray method can be used.

Figure 2A:
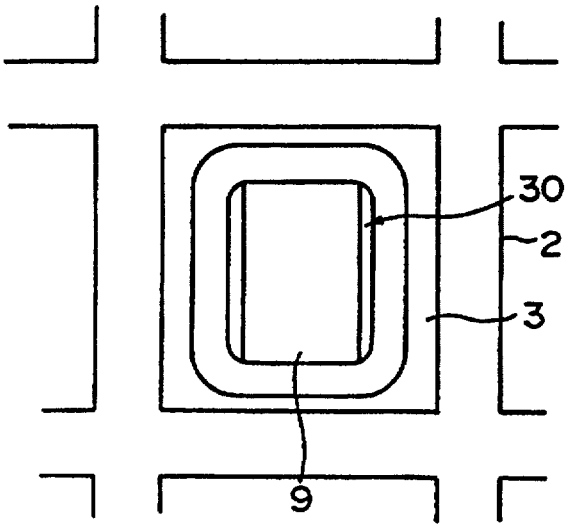
FIG. 2A is a plan view showing a fluorescent screen of a plasma display panel.
Figure 2B:
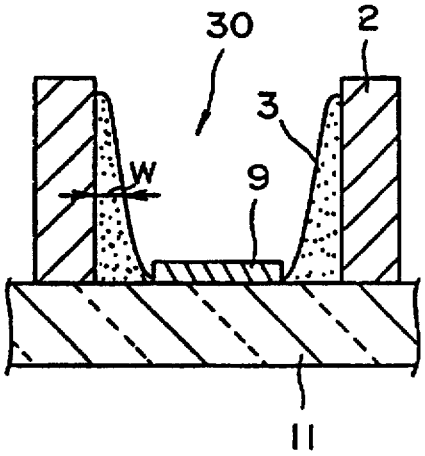
FIG. 2B is a side sectional view showing the plasma display panel.

Next, the fluorescent screens 3 formed on the wall surfaces of each barrier rib 2 will be described with reference to FIGS. 2A and 2B. FIG. 2A is a plan view showing the fluorescent screen 3, whereas FIG. 2B is a sectional view thereof. When viewed in a plane perpendicular to the substrate, the fluorescent screen 3 formed on the wall surfaces of each barrier rib 2 has a top portion 3*a* and a side portion 3*b*, and is nearly in a parabolic shape (see FIG. 2B). The horizontal area in the discharging space 30 defined by the fluorescent screen 3 gradually increases in the direction from the substrate 1 to the front plate 11 (also see FIG. 1(*h*)). As shown in FIG. 2A, when viewed from the top, the plane of the discharging space 30 is nearly in a rectangular shape where the four corners are rounded. Since the fluorescent screen 3 is disposed in the discharging space 30 in the parabolic shape where the area of the cross section of the fluorescent screen 3 gradually increases toward the front plate 11, rays of light emitted from the fluorescent screen 3 can be effectively radiated to the front plate 11.

Figures 15A, 15B, 15C:
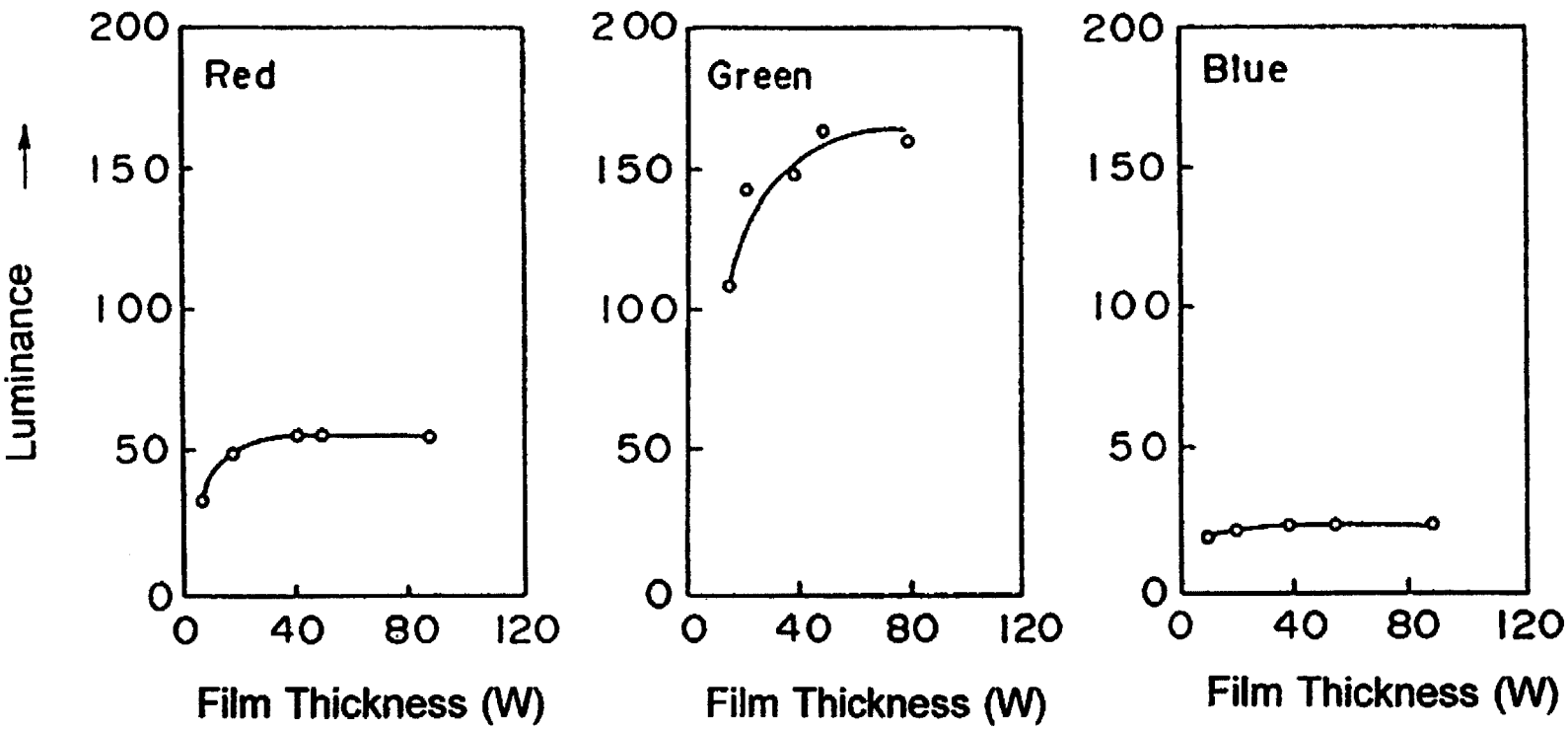
FIGS. 15(A) to 15(C) are graphs showing the relation between the film thickness of a fluorescent substance and the luminance thereof.

As described above, the film thickness (W) of the fluorescent screen 3 substantially at the center position on each wall surface of each barrier rib 2 is 40 μm. However, the film thickness W can be in the range from 20 to 50 μm. In other words, as shown in FIGS. 15(*a*) to (*c*), it is known that in the case of reflection type fluorescent screens for colors of R, G, and B, as the film thickness increases, the luminance increases. When the film thickness is in the range from 20 to 50 μm, the luminance becomes maximum. However, when the film thickness exceeds 50 μm, the luminance does not remarkably increase. Thus, in the above described embodiment, the film thickness of the fluorescent screen is set in the range from 20 to 50 μm.

1-2 Modified Example

Figure 3A:
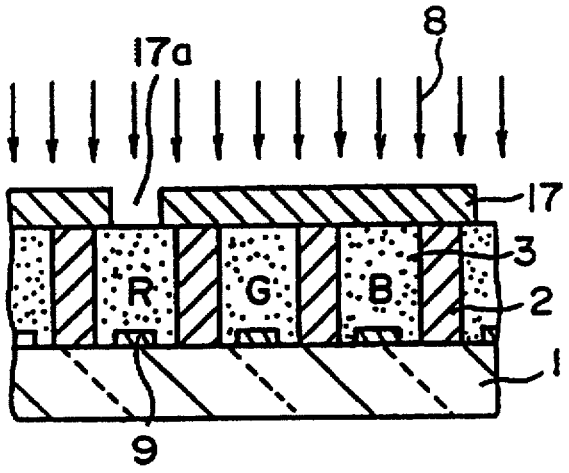
FIG. 3A is a side sectional view showing a sandblasting process using a sandblasting mask for use in an R cell space.
Figure 3B:
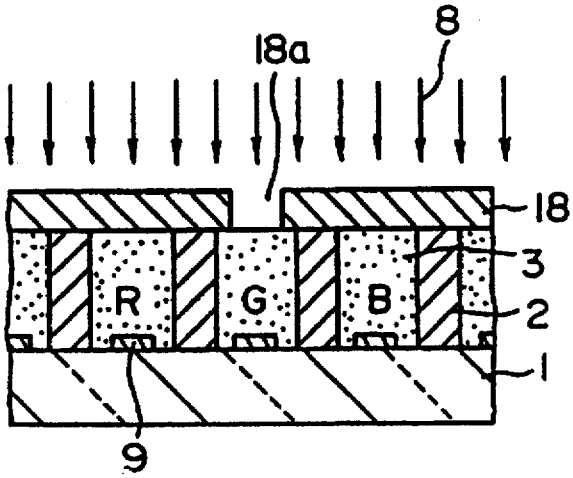
FIG. 3B is a side sectional view showing a sandblasting process using a sandblasting mask for use in a G cell space.
Figure 3C:
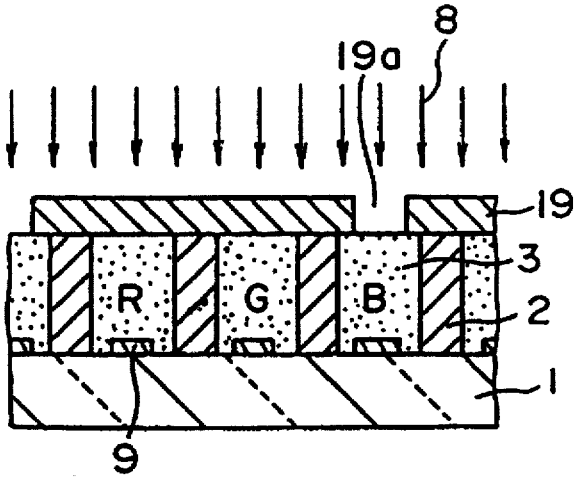
FIG. 3C is a side sectional view showing a sandblasting process using a sandblasting mask for use in a B cell space.
Figure 4A:
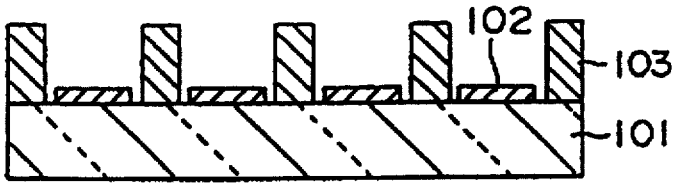
FIGS. 4(*a*) to 4(*e*) are schematic sectional views showing steps of a method for forming a fluorescent screen of a plasma display panel in accordance with a second embodiment of the present invention.
Figure 4B:
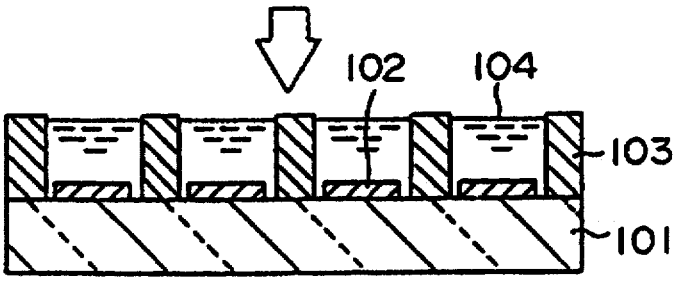
Figure 4C:
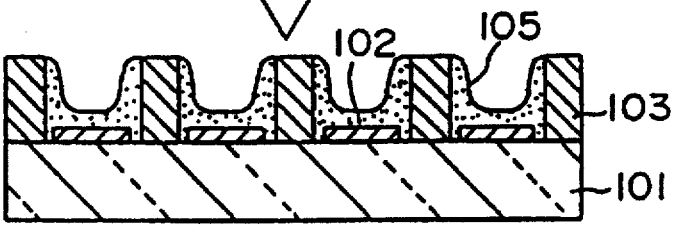
Figure 4D:
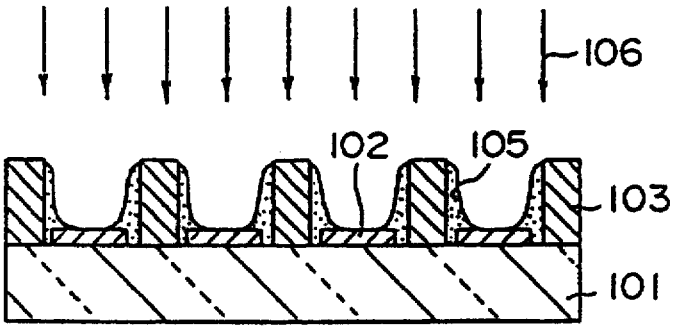
Figure 4E:
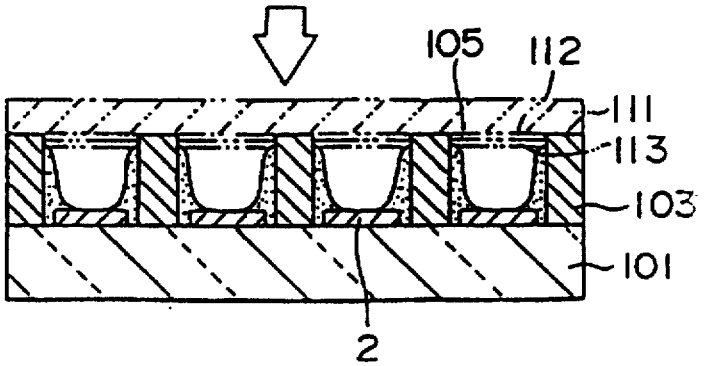

Next, a modified example of the first embodiment will be described with reference to FIGS. 3A to 3C. In FIG. 1(*e*), the openings 7*a* of the sandblasting mask 7 accorded with discharging spaces for three types of R, G, and B. However, as shown in FIG. 3A, a sandblasting mask 17 having openings 17*a* according to discharging spaces for R is used. Then, the sandblasting mask 17 is mounted on the barrier ribs 2. Next, the cell spaces are filled with a paste of fluorescent substance for R by rubber squeegeeing method or spraying method. Then, the paste of fluorescent substance is dried. Thereafter, grains of sand 8 are blasted through the openings 17*a*. Thus, a fluorescent screen 3 is formed in each discharging space for R. Next, a sandblasting mask 18 having openings 18*a* according to discharging spaces 18*a* for G is used. The discharging spaces are filled with a paste of fluorescent substance for G. Then, the paste is dried. Next, grains of sand 8 are blasted through the openings. Thus, a fluorescent screen is formed in each discharging space for G (see FIG. 3B). Thereafter, a sandblasting mask 19 having openings 19*a* according to discharging spaces for B is used. Then, the paste is dried. Next, grains of sand 8 are blasted through the opening 19*a*. Thus, a fluorescent screen is formed in each discharging space for B (see FIG. 3C).

According to this modified embodiment, exclusive sandblasting masks according to respective discharging spaces for R, G, and B are used to form three types of fluorescent screens. Thus, during the sandblasting process, incorrect discharging spaces are not filled with different types of fluorescent substances.

According to this modified example, as the sandblasting masks, photoresist masks or metal masks which were described in the above described embodiment can be used. When metal masks are used, three types of metal masks having openings 55 (see FIGS. 16 and 17) according to discharging spaces which are filled with the relevant pastes of fluorescent substances are provided and used one after the other.

Alternatively, one type of metal mask 50 can be used in such a way that the mask 50 is moved whenever the type of paste is changed. In this case, the metal mask 50 is mounted on the barrier ribs 2 so that openings 55 of the metal mask 50 match discharging spaces 30 for one color. Then, these discharging spaces 30 are filled with the paste of fluorescent substance for this color. Next, the paste is dried. Thereafter, grains of sand are blasted through these openings. Thus, a fluorescent screen for this color is formed. Thereafter, the same process is repeated for other two colors.

1-3 Effects

As described above, since the method for forming fluorescent screens of a plasma display panel of the present invention comprises the steps of filling predetermined discharging spaces with the paste of fluorescent substance 3 for each color by the screen printing method and performing the sandblasting process with the sandblasting mask 7, the fluorescent screens of the paste of fluorescent substance for each color are formed on the wall surfaces of each barrier rib along with the glass substrate 1. Thus, the fluorescent screens can be easily formed on parts other than the glass substrate unlike the conventional photolithography method and screen printing method. As a result, a plasma display panel with high luminous efficiency can be easily produced.

Second Embodiment 2-1 Basic Construction

Figure 5:
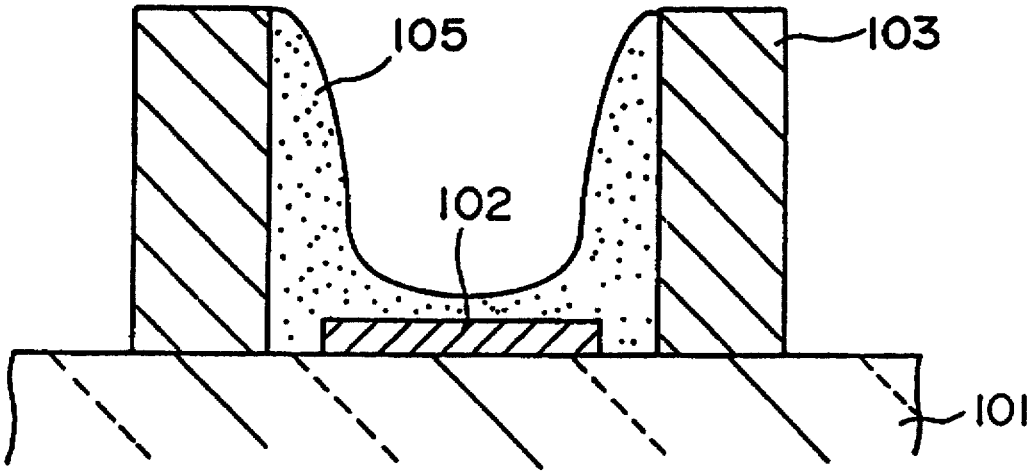
FIG. 5 is a side sectional view showing a shape of a fluorescent substance which remains after a solvent contained in a paste of a fluorescent substance is evaporated.
Figure 6A:
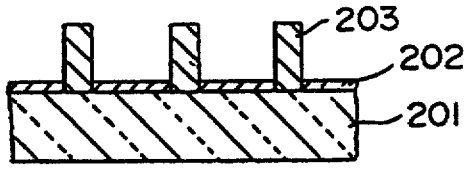
FIGS. 6(*a*) to 6(*f*) are schematic sectional views showing steps of a method for forming fluorescent screens of a plasma display panel in accordance with a third embodiment of the present invention.
Figure 6B:
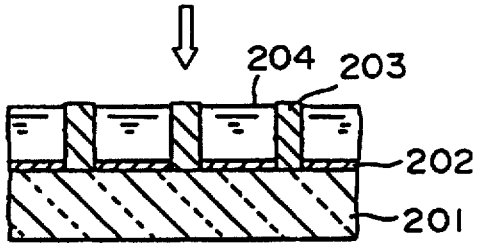
Figure 6C:
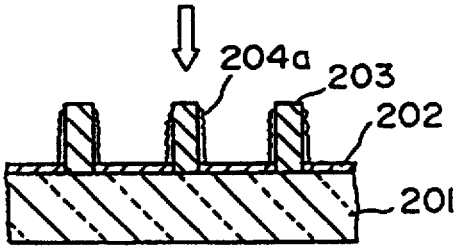
Figure 6D:
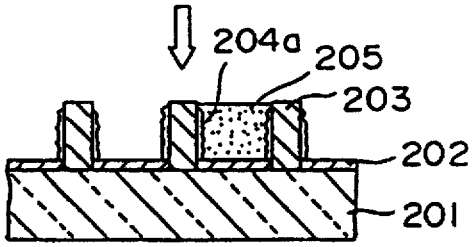
Figure 6E:
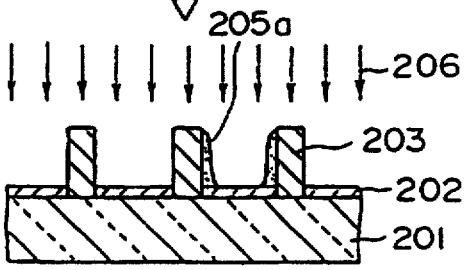
Figure 6F:
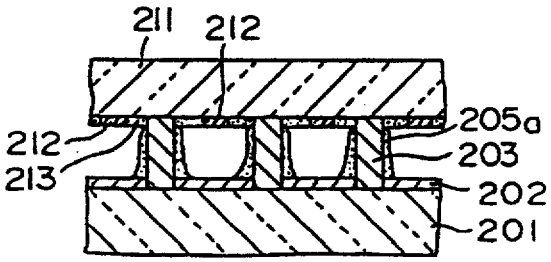
Figure 7A:
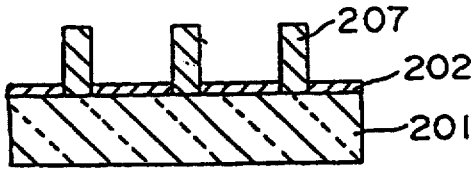
FIGS. 7(*a*) to 7(*f*) are schematic sectional views showing steps of another method for forming fluorescent screens of a plasma display panel in accordance with the third embodiment of the present invention.
Figure 7B:
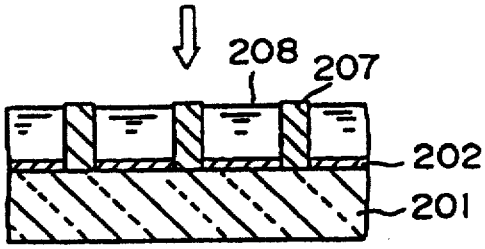
Figure 7C:
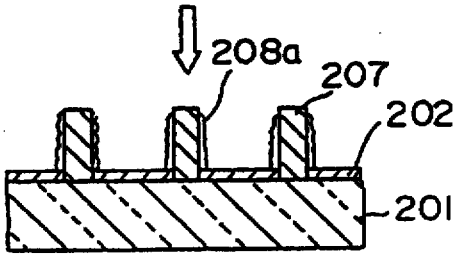
Figure 7D:
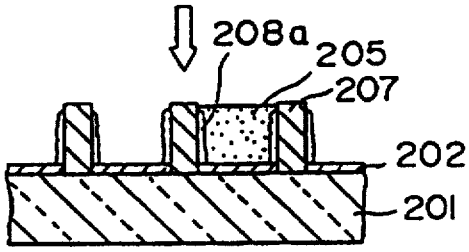
Figure 7E:
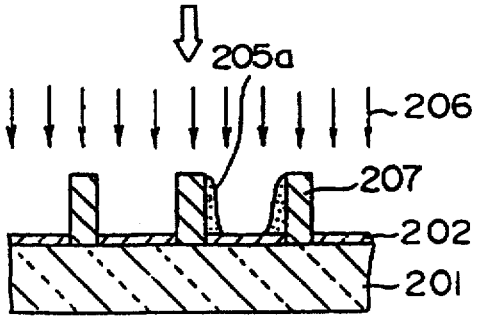
Figure 7F:
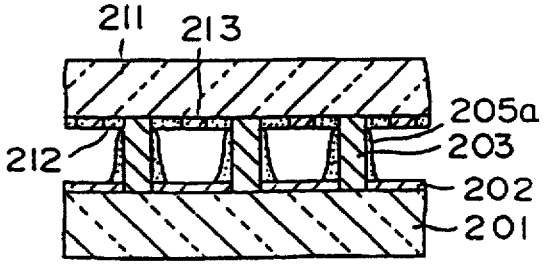

FIGS. 4 and 5 are schematic diagrams showing the construction of a second embodiment in accordance with the present invention. FIGS. 4(*a*) to (*e*) are schematic diagrams showing steps of a method for forming fluorescent screens of a plasma display panel in accordance with the present invention. Next, the method in accordance with the second embodiment will be described step by step.

First, as shown in FIG. 4(*a*), a pattern of electrodes 102 and barrier ribs 103 is formed on a substrate 101 made of glass and then sintered. In this embodiment, the electrodes 102 are patterned in a line shape with a pitch of 0.5 mm, a line width of 0.3 mm, and a film thickness of 20 μm. On the other hand, the barrier ribs 103 are patterned in a matrix shape with a pitch of 0.5 mm, a line width of 100 μm, and a film thickness of 200 μm.

Next, as shown in FIG. 4(*b*), cell spaces as discharging spaces defined by the barrier ribs 103 are filled with three types of pastes of fluorescent substances 104 for three colors R, G, and B by the screen printing method so that these colors are arranged in a predetermined sequence. In this embodiment, each of the pastes of fluorescent substances 104 which is a mixture composed of a fluorescent material of 50 wt %, turbine oil of 46 wt % as an organic solvent, and ethyl cellulose of 4 wt % as a binder is used. In this embodiment, as the filling method of the pastes of fluorescent substances, the screen printing method is used. However, it should be noted that this filling method does not limit the present invention. Instead, another filling method such as spraying method can be used.

As shown in FIG. 4(*c*), after filling with each of the pastes of fluorescent substances 104, it is dried at a temperature of 170° C. During this drying step, the organic solvent of approximately 75% by volume is vaporized from each of the pastes of fluorescent substances 104. Thus, a fluorescent substance 105 for each color resides in a shape as shown in FIG. 5, the fluorescent substance 105 being composed of a mixture of a fluorescent material and a binder.

Next, as shown in FIG. 4(*d*), grains of sand 106 are blasted so as to remove unnecessary portions of the fluorescent substance for each color. In this step, glass beads #600 (abrasive) instead of the grains of sand 106 are used. The sandblasting process is performed with a blasting pressure of 1 kg/cm$^2$. Thus, the fluorescent screens 105 for each color are formed on the wall surfaces of the barrier ribs 103. At this point, the front surface of each electrode 102 is exposed so as to form a discharging space. Since the electrode material and the cell wall material have been sintered, the sandblasting process speed of the electrodes and the barrier ribs is slower than that of the fluorescent screens 105. Thus, the sandblasting process can be performed almost without damaging the front surface of each electrode 102 and the upper portion of each barrier rib 103. In addition, the film thickness of the fluorescent screen 105 adhering on the wall surfaces of each barrier rib 103 can be controlled under the condition of the sandblasting process and by the operating time thereof.

In the last step shown in FIG. 4(*e*), the fluorescent screens 105 are sintered at a peak temperature of 445° C. for a holding time of 10 to 20 minutes. Thus, the fluorescent screens 105 are securely formed on the wall surfaces of the barrier ribs 103. Thereby, the fluorescent screens 105 having a film thickness of 40 μm at the center portion of the barrier ribs in a height direction thereof for each color of R, G, and B are formed on the wall surfaces of the relevant barrier ribs 103. On the barrier ribs 103, a front plate 111 formed of electrodes 112 and fluorescent screens 113 is disposed and opposed to the substrate 101 by way of the discbarging spaces. As a result, a plasma display panel is obtained.

2-2 Effects

As described above, since the method for forming fluorescent screens of a plasma display panel of the present invention comprises the steps of filling relevant discharging spaces with the paste of fluorescent substance 104 for each color by the screen printing method and performing the sandblasting process without a sandblasting mask, the fluorescent screens of the paste of fluorescent substance for each color are formed on the wall surfaces of each barrier rib 103. Thus, the fluorescent screens can be easily formed on parts other than the glass substrate unlike the conventional photolithography method and screen printing method. As a result, a plasma display panel with high luminous efficiency can be easily produced. In addition, without necessity of a sandblasting mask, the sandblasting process can be performed and the entire process time can be shortened. Moreover, since deterioration of the pattern shape due to matching of the sandblasting mask and barrier rib pattern does not take place, fluorescent screens can be formed advantageously on a large substrate.

Third Embodiment 3-1 Description of Conventional Plasma Display Panel

Figure 8:
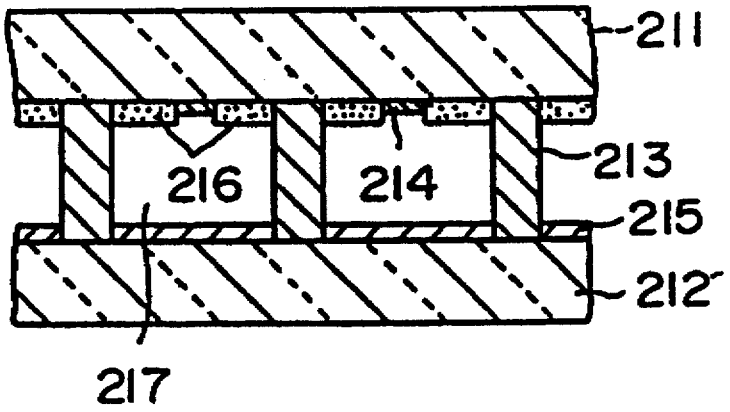
FIG. 8 is a partial sectional view showing the construction of a conventional DC type plasma display panel.

FIG. 8 shows an example of the construction of a conventional DC type plasma display panel (PDP). As shown in the figure, in the DC type PDP, a front plate (substrate) 211 and a rear plate 212 which are plane and composed of glass are opposed to each other. The front plate 211 and the rear plate 212 are spaced apart by a specific distance with barrier ribs 213 interposed therebetween. In addition, on the rear surface of the front plate 211, anodes 214 are formed. On the front surface of the rear plate 212, cathodes 215 are formed in such a way that the cathodes 215 are opposed to the respective anodes 214. On both the sides of each anode 214, a fluorescent screen 216 is adjacently formed.

In the above described DC type PDP, a predetermined voltage supplied by a DC power source is applied between each anode 214 and each cathode 215 so that an electric field takes place. Thus, inside each discharging space 217 as a display element composed of the front plate 211, the rear plate 212, and each barrier rib 213, discharging is performed and thereby ultraviolet rays are generated. The ultraviolet rays cause the fluorescent screen 216 on the rear surface of the front plate 211 to emit light. As a result, a viewer can view the rays which pass through the front plate 211.

Figure 9:
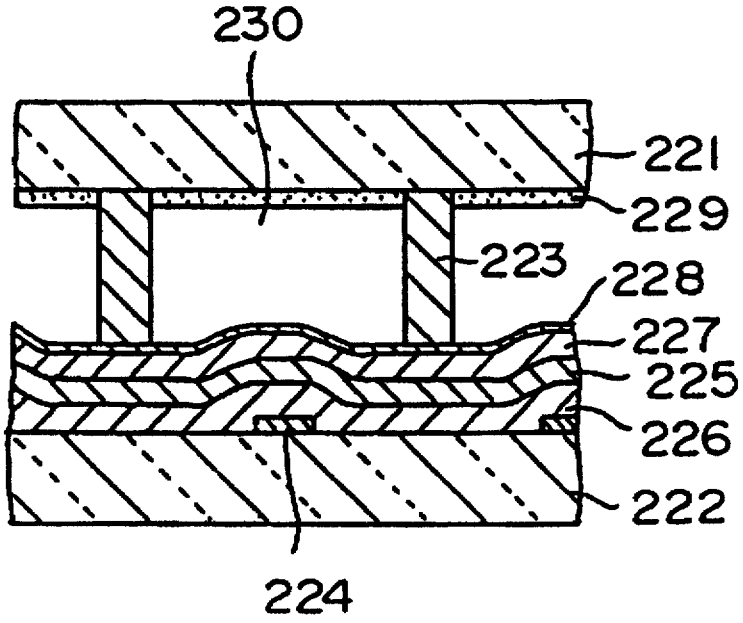
FIG. 9 is a partial sectional view showing the construction of a conventional AC type plasma display panel.

FIG. 9 shows an example of the construction of a conventional AC type plasma display panel (PDP). As shown in the figure, like the above described DC type PDP, in the AC type PDP, a front plate 221 and a rear plate 222 which are plane and composed of glass are opposed to each other. The front plate 221 and the rear plate 222 are spaced apart by a specific distance with barrier ribs 223 disposed therebetween. In the AC type PDP, two types of electrodes 224 and 225 which are opposed to each other are formed on the front surface of the rear plate 222 through a dielectric layer 226. In addition, on the front surface of the electrode 225, a dielectric layer 227 and a protection layer 228 are formed. Moreover, on the rear surface of the front plate 221, a fluorescent screen 229 is formed.

In the above described conventional AC type PDP, by applying a predetermined voltage supplied by an AC power source between the two electrodes 224 and 225, an electric field is created. Thus, inside each discharging space 230 formed by the front plate 221, the rear plate 222, and each barrier rib 223 as a display element, discharging is performed and thereby ultraviolet rays are generated. The ultraviolet rays cause the fluorescent screen 229 on the rear surface of the front panel 221 to emit light. A viewer can view these rays which pass through the front plate 221.

Figure 10:
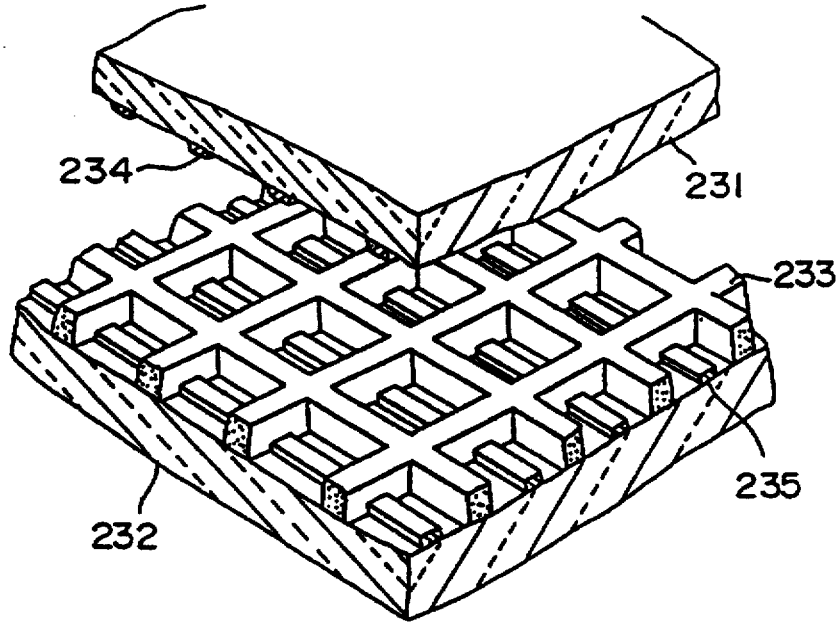
FIG. 10 is a partial perspective view showing a DC type plasma display panel with matrix shaped barrier ribs.
Figure 11:
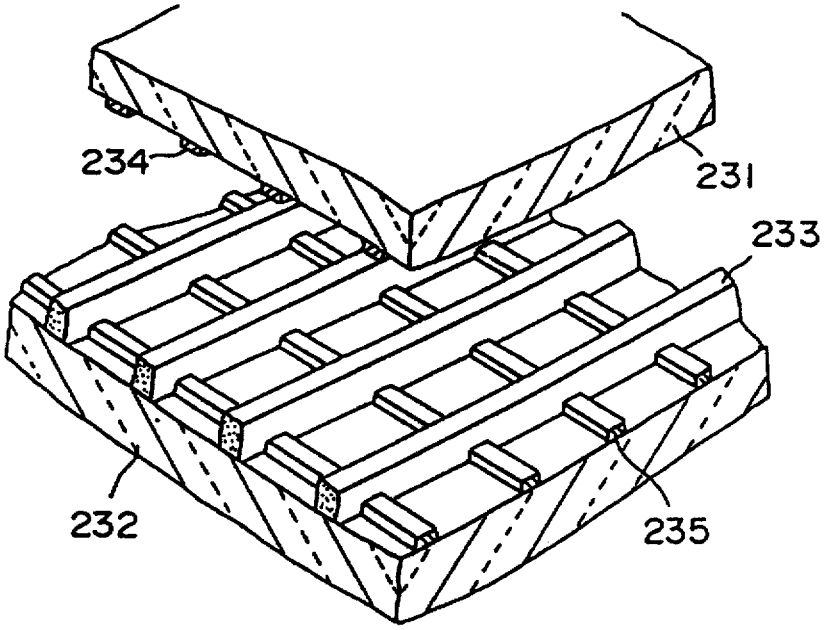
FIG. 11 is a partial perspective view showing a DC type plasma display panel with line shaped barrier ribs.

As the above-mentioned barrier ribs, matrix shape type barrier ribs and line shape type barrier ribs are well known. For example, in the case of the DC type PDP, FIG. 10 shows matrix shape type barrier ribs, whereas FIG. 11 shows line shape type barrier ribs. In FIGS. 10 and 11, reference numeral 231 designates a front panel disposed on the viewer side. Reference numeral 232 designates a rear plate. Reference numeral 232 is a rear plate. Reference numeral 233 is a barrier rib. Reference numeral 234 designates an anode. Reference numeral 235 designates a cathode. In FIGS. 10 and 11 show a PDP where the barrier ribs are formed on the rear plate 232. However, it should be noted that the barrier ribs can be formed on the front plate 231.

As shown in FIGS. 8 and 9, the fluorescent screens of the DC type PDP or the AC type PDP are formed in the following manner. After a photosensitive slurry solution containing a fluorescent substance is coated on the rear surface of the front plate, the front plate is exposed with a photo mask in accordance with the pattern of the fluorescent substance. Thereafter, the front plate is developed and sintered. Thus, the fluorescent screens are formed. For example, as the photosensitive slurry, a mixture of containing fluorescent substance, polyvinyl alcohol (PVA), and diazonium salt can be used. In some situations, a defoaming agent or a surfactant can be used.

However, in the above-mentioned PDPs, rays which are emitted from each fluorescent screen pass through itself and reach the viewer. Thus, when the rays pass through each fluorescent screen, the amount of light decreases. To solve this problem, a PDP with fluorescent screens formed on the wall surfaces of the barrier ribs has been proposed. By using this PDP, since the viewer can directly view rays emitted from the wall surfaces of the barrier ribs, the luminance is increased.

Figure 12:
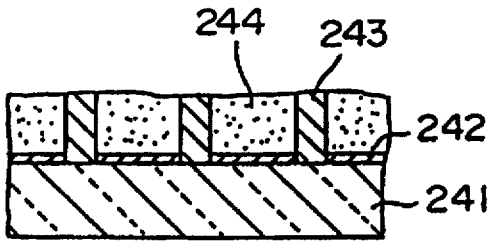
FIG. 12 is a side sectional view showing a step of a conventional method for forming fluorescent screens.
Figure 13:
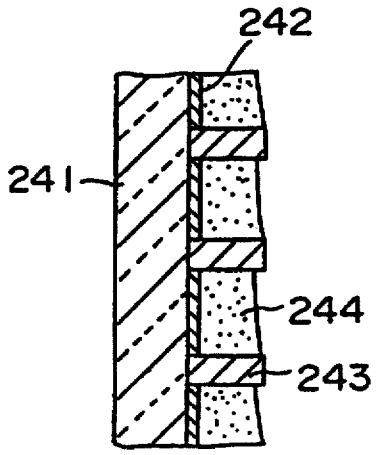
FIG. 13 is a side sectional view showing a step following the step of FIG. 12.
Figure 14:
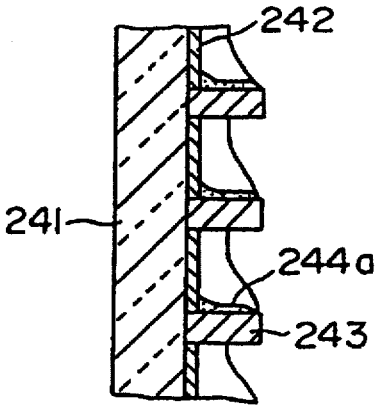
FIG. 14 is a side sectional view showing a step following the step of FIG. 13.

FIGS. 12 to 14 show steps of the method for forming such fluorescent screens. In this method, as shown in FIG. 12, barrier ribs 243 are disposed in perpendicular to cathodes 242 on a rear plate 241. After discharging spaces defined by the barrier ribs 243 and the cathodes 243 are filled with a fluorescent substance slurry solution 244, the rear plate 241 is placed in an upright position as shown in FIG. 13. The rear plate 241 is left gently in this position until a fluorescent substance **244*a* contained in the fluorescent substance slurry solution 244 settles downwardly on the wall surfaces of the barrier ribs 243. Thereafter, the rear plate 241 is dried in this position. In this manner, the fluorescent substance 244*a* is adhered on the wall surfaces of the barrier ribs 243. By using a negative photosensitive solution as the fluorescent substance slurry solution 244 and obliquely exposing only the wall surfaces of the barrier ribs 243 to ultraviolet rays through a mask, only the fluorescent substance 244*a* on the wall surfaces of the barrier ribs 243 can be hardened. Thereafter, by a developing process, the fluorescent screens can be formed on the wall surfaces of the barrier ribs 243. By repeating these steps three more times, the fluorescent screens can be formed on all the four sides of wall surfaces of the barrier ribs 243** sectioned in a matrix shape. Thereafter, this process is repeated for all three colors red (R), green (G), and blue (B) so as to form the fluorescent screens with the three primary colors.

3-2 Basic Construction 3-2-1 First Example

Next, a first example of the present invention will be described with reference to FIG. 6.

First, as shown in FIG. 6(*a*), electrodes 202 composed of Ni and having a width of 300 μm were formed on the front surface of a substrate 201 (rear plate) composed of glass by a screen printing method. Thereafter, barrier ribs 203 which were in a square matrix shape and had a height of 200 μm, a width of 150 μm, and a pitch of 500 μm were formed. Next, as will be described later, the inside of each barrier rib 203 was equally filled with an aqueous solution 204 of boric acid of 2% so as to adhere boric acid which was a bridging agent of polyvinyl alcohol (PVA) used as a paste of fluorescent substance-as shown in FIG. 6(*b*). At this point, to fill the inside of the barrier rib 203 easily and equally, the aqueous solution 204 of boric acid of 2% had been mixed with methyl alcohol of 5%. When the barrier rib 203 was dried, since it absorbed moisture, the bridging agent **204*a* composed of boric acid was concentrated on the wall surfaces of the barrier rib 203 as shown in FIG. 6**(*c*).

After the drying process, as shown in FIG. 6(*d*), predetermined cells were selectively filled with a paste of fluorescent substance 205 by the screen printing process. In this case, as the paste of fluorescent substance, 60 g of a binder which was a mixture of an aqueous solution of PVA-224 of 10% (50 g), n-butanol (5 g), and ethylene glycol (50 g) was mixed with 100 g of fluorescent substance. The resultant mixture was dispersed by using three rolls. As the fluorescent substance for red color, $(Y,Gd)BO_3:Eu^{3+}$ was used. As the fluorescent substance for green color, $Zn_2SiO_4:Mn$ was used. As the fluorescent substance for blue color, $BaMgAl_{14}O_{23}:Eu^{2+}$ was used.

After being filled with the paste of fluorescent substance 205, the rear plate was left for 10 minutes as a bridging time. Thereafter, as shown in FIG. 6(*e*), the paste of fluorescent substance 205 was developed by spraying hot water 206. Thus, the unnecessary paste of fluorescent substance 205 which was not bridged in the barrier rib 203 was removed. As a result, a fluorescent substance **205*a* was formed on the wall surfaces of the barrier rib 203. By repeating this process for all the three colors R, G, and B, the fluorescent screen could be formed on the wall surfaces of the barrier rib 203**, the film thickness nearly at the center position thereof being 30 μm.

Next, as shown in FIG. 6(*f*), a front plate 211 was disposed on the barrier rib 203. As a result, a plasma display panel was obtained. In this example, on the rear surface of the front plate 211, an electrode 212 was disposed. In addition, a fluorescent screen 213 was disposed adjacent to the electrode 212 on the front plate 211.

3-2-2 Second Example

In this example, as a bridging agent of PVA contained in a paste of fluorescent substance, $Cu_2SO_4$ was used. Next, with reference to FIG. 7, this example will be described.

First, a paste for printing barrier ribs formed by the screen printing process was mixed with $Cu_2SO_4$ (bridging agent) of 2 wt % and then well dispersed. Thereafter, as shown in FIG. 7(*a*), using this paste, barrier ribs 207 were formed on a rear plate 201 in the same pattern as the first example shown in FIG. 6 by the screen printing process. Thus, the bridging agent was inserted into each barrier rib 207. Then, as shown in FIG. 7(*b*), the barrier rib 207 was filled with an aqueous solution 208 of $Na_2CO_3$ of 3% as a bridging accelerating agent. Thereafter, when the barrier rib 207 was dried, it absorbed moisture. Thus, a bridging accelerating agent 208*a* composed of $Na_2CO_3$ was adhered on the wall surfaces of the barrier rib 277. This bridging accelerating agent was used to accelerate the bridging reaction of PVA with the bridging agent inserted in the barrier rib 207.

After the drying process, as shown in FIG. 7(*d*), predetermined cells were selectively filled with the paste of fluorescent substance 205 which was the same as that used in the first example shown in FIG. 6 by the screen printing process. After the cells were filled with the paste of fluorescent substance 205, they were left for 10 minutes as a bridging time. Thereafter, as shown in FIG. 7(*e*), the paste of fluorescent substance 205 was developed by spraying hot water 206. By repeating this process for all the three colors R, G, B, a fluorescent screen 205*a* could be formed on each surface of the barrier rib 207, the film thickness nearly at the center position of each cell wall thereof being 30 μm. Next, as shown in FIG. 7(*f*), a front plate 211 was disposed on the barrier rib 207. As a result, a plasma display panel was obtained. In this example, on the rear surface of the front plate 211, an electrode 212 was disposed. In addition, a fluorescent screen 213 was disposed adjacent to the electrode 211 on the front plate 211.

3-3 Other Example

When PVA is used as a resin contained in a paste of fluorescent substance, as a bridging agent, borax, diazonium salt, aluminium compound, a titanium compound, a zirconia compound, or a tin compound can be used as well as boric acid or a copper compound.

As a combination of a resin contained in a paste of fluorescent substance and a bridging agent of the resin, (polyvinyl pyrrolidone and sodium salt), (ammonium persulfate, sodium phosphate, or methyl methacrylate and azobisisobutyro-nitrile), (cellulose and dimethylolurea), (polychloroprene rubber or hydride rubber and zinc chloride), (nitrile rubber and copper sulfide), (acrylonitrile-butadiene copolymer and zinc chloride or tin chloride), (polyacrylic ester and γ-aminopropyltriethoxysilane), (1-chlorobutadiene and aminosilane coupling agent), (trimethoxysilanegraftpolyethylene and water), or the like can be used.

In the above-mentioned first and second examples, PDPs with barrier ribs in a matrix shape were described. However, it should be noted that the present invention can be applied to PDPs with barrier ribs in a line shape or a circular shape.

In the above-mentioned embodiments, the filling process and the developing process of paste of fluorescent substance were performed three times for three colors R, G, and B. However, predetermined discharging spaces can be filled with the paste of fluorescent substance for each of R, G, and B continuously by the screen printing process. Thus, the developing process can be reduced to one time instead of three times.

Moreover, the filling method of paste of fluorescent substance is not limited to the above-mentioned screen printing method. Spray method, blade coat method, or the like can be used.

3-4 Effects

As described above, according to the method for forming fluorescent screens of the present invention, a bridging agent is provided in a barrier rib 203, 207. Thus, predetermined discharging spaces are filled with a paste of fluorescent substance 205 contained in a resin to be bridged with the bridging agent. Only the resin adjacent to the barrier rib 203, 207 is bridged and hardened so that it has a predetermined thickness. Thus, a fluorescent substance 205*a* is formed. As a result, the fluorescent screens 205*a* can be easily and accurately formed on the surfaces of the barrier rib 203, 207 in a short time with a desired thickness. As a result, a PDP with high intensity where the viewer can view reflected rays therefrom can be obtained.

Although the present invention has been shown and described with respect to a best mode embodiment thereof, it should be understood by those skilled in the art that the foregoing and various other changes, omissions, and additions in the form and detail thereof may be made therein without departing form the spirit and scope of the present invention.

What is claimed is:

1. A plasma display panel, comprising:

a rear plate;

a front plate;

barrier ribs interposed between said rear plate and said front plate, said barrier ribs having side walls extending substantially perpendicular to said front and rear plates;

an electrode disposed on said rear plate; and a fluorescent screen formed on each side wall of said barrier ribs such that said electrode is exposed and an area in a plane parallel to said front and rear plates in a discharging space defined and formed by said fluorescent screen is substantially rectangular in shape with rounded corners and gradually increases toward said front plate, wherein said fluorescent screen has a film thickness ranging from 30 to 50 μm substantially at the center position of each side wall of said barrier ribs.

2. The plasma display panel as set forth in claim 1, wherein the cross-sectional shape of said fluorescent screen formed on said barrier ribs is substantially parabolic.

3. A plasma display panel, comprising:

a rear plate;

a front plate;

barrier ribs interposed between said rear plate and said front plate, said barrier ribs having side walls extending substantially perpendicular to said front and rear plates;

an electrode disposed on said rear plate; and a fluorescent screen formed on each side wall of said barrier ribs such that said electrode is exposed and an area in a plane parallel to said front and rear plates in a discharging space defined and formed by said fluorescent screen is substantially rectangular in shape with rounded corners and gradually increases toward said front plate, wherein said fluorescent screen has a film thickness ranging from 30 to 50 μm substantially at the center position of each side wall of said barrier ribs;

wherein said plasma display panel is formed by the following steps:

disposing a plurality of barrier ribs on said rear plate;

filling predetermined discharging spaces with three types of paste of fluorescent substances for red, green and blue;

performing a sandblasting process using a sandblasting mask with openings, each of said openings being smaller than the area of each of said discharging spaces; and performing a sintering process to form said fluorescent screens on the side walls of said barrier ribs.

4. A plasma display panel, comprising:

a rear plate having a plurality of first electrodes formed thereon;

a front plate;

barrier ribs interposed between said rear plate and said front plate, said barrier ribs having side walls extending substantially perpendicular to said front and rear plates; and a fluorescent screen formed on each side wall of said barrier ribs such that each of said first electrodes is exposed and an area in a plane parallel to said front and rear plates in a discharging space defined and formed by said fluorescent screen is substantially rectangular in shape with rounded corners and gradually increases toward said front plate, wherein said fluorescent screen has a film thickness ranging from 30 to 50 μm substantially at the center position of each side wall of said barrier ribs;

wherein said plasma display panel is formed by the following steps:

disposing a plurality of barrier ribs on said rear plate having said plurality of first electrodes formed thereon;

filling predetermined discharging spaces with three types of pastes of fluorescent substances for red, green and blue;

drying said pastes of fluorescent substances to vaporize a solvent contained in said pastes of fluorescent substances;

performing a sandblasting process to remove unnecessary fluorescent substances from the side walls of said barrier ribs while leaving necessary fluorescent substances on the side walls; and performing a sintering process to secure said fluorescent screens to the side walls of said barrier ribs.

5. A plasma display panel, comprising:

a rear plate;

a front plate;

barrier ribs interposed between said rear plate and said front plate, said barrier ribs having side walls extending substantially perpendicular to said front and rear plates;

an electrode disposed on said rear plate; and a fluorescent screen formed on each side wall of said barrier ribs such that said electrode is exposed and an area in a plane parallel to said front and rear plates in a discharging space defined and formed by said fluorescent screen is substantially rectangular in shape with rounded corners and gradually increases toward said front plate, wherein said fluorescent screen has a film thickness ranging from 30 to 50 μm substantially at the center position of each side wall of said barrier ribs;

wherein said plasma display panel is formed by the following steps:

disposing a plurality of barrier ribs on said rear plate, surfaces of said barrier ribs having a predetermined bridging agent;

filling predetermined discharging spaces with pastes of fluorescent substances containing a resin to be bridged with said bridging agent;

leaving said rear plate for a predetermined bridging reaction time; and developing said pastes of fluorescent substances to form said fluorescent screens on the side walls of said barrier ribs.

* * * * *